US011111729B2

(12) United States Patent
Kosovich

(10) Patent No.: US 11,111,729 B2
(45) Date of Patent: Sep. 7, 2021

(54) MULTI-INDENTER HAMMER DRILL BITS AND METHOD OF FABRICATING

(71) Applicant: Mincon International Limited, Shannon (IE)

(72) Inventor: John Kosovich, Shannon (IE)

(73) Assignee: MINCON INTERNATIONAL LIMITED, Shannon (IE)

( * ) Notice: Subject to any disclaimer, the term of this patent is extended or adjusted under 35 U.S.C. 154(b) by 24 days.

(21) Appl. No.: 16/463,982

(22) PCT Filed: Nov. 29, 2017

(86) PCT No.: PCT/EP2017/080802

§ 371 (c)(1),
(2) Date: May 24, 2019

(87) PCT Pub. No.: WO2018/099959

PCT Pub. Date: Jun. 7, 2018

(65) Prior Publication Data

US 2020/0080384 A1 Mar. 12, 2020

(30) Foreign Application Priority Data

Nov. 29, 2016 (GB) ..... 1620220.2

(51) Int. Cl.

| | |
|---|---|
| ***E21B 10/56*** | (2006.01) |
| ***E21B 10/36*** | (2006.01) |
| ***E21B 10/00*** | (2006.01) |

(52) U.S. Cl.

CPC ..... *E21B 10/56* (2013.01); *E21B 10/36* (2013.01); *E21B 10/00* (2013.01)

(58) Field of Classification Search

CPC ..... E21B 10/56; E21B 10/36; E21B 10/00

See application file for complete search history.

(56) References Cited

U.S. PATENT DOCUMENTS

| | | | | | |
|---|---|---|---|---|---|
| 3,163,243 | A * | 12/1964 | Cleary | E21B 10/40 | 175/389 |
| 3,583,504 | A * | 6/1971 | Aalund | E21B 10/56 | 175/398 |
| 3,885,638 | A * | 5/1975 | Skidmore | E21B 10/56 | 175/390 |

(Continued)

FOREIGN PATENT DOCUMENTS

| | | |
|---|---|---|
| EP | 2921639 A1 | 9/2015 |
| JP | 2007-277946 A | 10/2007 |

OTHER PUBLICATIONS

International Search Report from corresponding International Patent Application No. PCT/EP17/80802, dated Apr. 9, 2018.

*Primary Examiner* — Giovanna Wright
*Assistant Examiner* — Jonathan Malikasim
(74) *Attorney, Agent, or Firm* — Kusner & Jaffe

(57) ABSTRACT

A multi-indenter drill bit includes a plurality of indenters arranged on a drilling surface of a bit face. The ratio of the total indenter area to the bit face area is defined by a parameter $KPI_1$ (expressed as a percentage), and the ratio of the average individual indenter area to the bit face area is defined by a parameter $KPI_2$, (expressed as a percentage). The relationship between $KPI_1$ and $KPI_2$ is defined by an equation.

15 Claims, 6 Drawing Sheets

(56) References Cited

U.S. PATENT DOCUMENTS

| | | | | | |
|---|---|---|---|---|---|
| 5,881,828 | A * | 3/1999 | Fischer | E21B 10/56 | 175/374 |
| 5,947,215 | A | 9/1999 | Lundell | | |
| 5,992,547 | A * | 11/1999 | Caraway | E21B 10/003 | 175/385 |
| 6,658,968 | B2 * | 12/2003 | Linden | E21B 10/56 | 175/414 |
| 7,207,402 | B2 * | 4/2007 | Bjork | E21B 10/56 | 175/418 |
| 7,455,126 | B2 * | 11/2008 | Cruz | E21B 10/36 | 175/415 |
| 8,550,190 | B2 * | 10/2013 | Hall | E21B 10/26 | 175/385 |

* cited by examiner

MULTI-INDENTER HAMMER DRILL BITS AND METHOD OF FABRICATING

FIELD OF THE INVENTION

The present invention relates to percussion drill bits and, in particular, to the size, number placement and spacing of multiple indenters on a drill bit.

BACKGROUND TO THE INVENTION

Modern percussion drill bits use spherical or (more or less) conical indenters (also called 'buttons') to remove chips from a rock mass (FIG. 1). When drilling, a network of cracks is created in the rock under an indenter when the indenter is loaded with sufficient force to substantially penetrate the rock mass and subsequently unloaded. When these cracks intersect with the free surface of the rock mass, rock chips are liberated. From a drilling productivity perspective, the applied work (i.e. force× penetration distance) per loading cycle is most efficiently utilised where the liberated chip volume/applied work ratio is as high as possible. If, for any reason, the crack network created by an indenter does not intersect the rock surface, then it does not liberate rock chips and, effectively, much of the work applied to the indenter is wasted.

The volume of chips liberated by a single indenter is a function of the work applied to the indenter, the diameter and shape of the indenter, and the properties of the rock being drilled. Smaller diameter indenters require less applied work to penetrate the rock to a given distance, as do 'sharper' (i.e. more conical) indenters. So, generally speaking, for a given rock strength, a smaller, sharper indenter will create a better chip volume/applied work ratio (i.e. be more efficient) than a larger, more 'blunt' one.

When two (or more) indenters are placed in close proximity to each other and are simultaneously loaded and unloaded there is a possibility that the crack networks created by each will coalesce (FIG. 2). In this case, cracks from the individual indenters, that might not otherwise liberate rock chips, combine in a way which liberates a much larger volume of chips than the indenters, operating individually, would have liberated. This effect can therefore create an even more efficient use of the work applied to the indenters. The overall volume liberated (by the combination of local and inter-indenter cracking) is a function of all the variables mentioned above and, also, of the indenter spacing. Too narrow a spacing will not provide for optimum coalescence of cracks while too wide a spacing may not result in any coalescence at all. That is, if the indenter spacing is too large, there is no increase in chip liberation volume over the indenters operating individually (FIG. 2*d*). Optimising the spacing between indenters on a drill bit would thus provide for an improved drilling performance over a corresponding drill bit wherein the spacing has not been optimised. Generally speaking, the optimum spacing for the indenters will decrease with increasing rock strength, and increase with higher applied work per loading cycle. So, where the rock strength increases, if the applied work can be increased appropriately, the optimum indenter spacing will stay relatively constant.

Now, in percussion drilling, the applied work (that brings about indenter penetration) is created by the collision of a moving 'impact piston' with the drill bit. The magnitude of this work is a function of the impact piston's mass and the collision speed. The higher the mass and speed, the higher the work applied. However, in practical terms, the amount of work available per cycle is limited by the mechanical strength of both the impact piston and the drill bit itself. Larger impact mechanisms can apply more work but there is a practical limit to the overall level of work that can be applied to the drill bit and thus, also, a limit to the amount of work available per indenter, on average. So, where the rock strength increases it may not be possible to adjust the applied work sufficiently and the optimum indenter spacing may then decrease. Thus, to drill such high strength rock types efficiently, a change in drill bit design is required; to one where the indenter spacing is reduced. For a given size of drill bit this means a bit with more indenters.

Now, where the drill bit design changes to one with more indenters, the average applied work/indenter drops. This reduces the optimum spacing further, requiring more indenters again. In practical terms, given this 'positive feedback loop', it may not be possible to reach the optimum indenter spacing by changing the number of indenters alone. In these situations, the optimum spacing most likely can only be reached by also changing the indenter size and/or shape. A drill bit design with smaller and/or sharper indenters most likely will be required.

There is one other practical consideration: In a drill bit with a low number of indenters and/or one where the indenter size is small relative to the size of the bit, the indenters will be subject to more wear during use and thus will not maintain their shape as long (i.e. they will tend to become blunt more quickly). This will change the optimum spacing during use. This wear life consideration tends to lead current drill bit designs to larger indenters, which increases the optimum indenter spacing and also reduces drilling efficiency. However, the wear life 'problem' can equally be solved by increasing the number of indenters, to increase the proportion of the bit face that is occupied by indenters. This has been largely overlooked in existing drill bit designs.

So, for each rock type and maximum available applied (percussion) work, determining the most efficient drill bit design, with an acceptable wear life, becomes a complex multi-dimensional problem involving the variables of indenter size, shape, and number. Research has shown that, most often, the optimum solution is one where the size of the indenters used is decreased, while the number of indenters is increased, when compared to current drill bit designs. Furthermore, in hydraulic (as opposed to pneumatic) drilling systems, the applied work available is not influenced by the size and number of exhaust holes and exhaust channels in a drill bit face. Thus, for hydraulically powered drilling systems there is the possibility to re-size or completely remove some exhaust holes and exhaust channels from the bit's face and replace them with additional drilling indenters. This also allows for a more consistent spacing of indenters across the bit face.

Drilling bit designs in common use today are very often not optimised, especially for hydraulically powered drilling systems, and calculations, backed up by experimental data, have shown that significant improvements in performance and wear life can be achieved where the drill bit is optimised to the rock conditions and also to the impact mechanism it is fitted to. Most often this optimisation involves using smaller indenters of a greater number and normalising their spacing (as much as possible) with the resizing or removal of flushing holes and channels.

SUMMARY OF THE INVENTION

The present invention provides a multi-indenter drill bit comprising a plurality of indenters arranged on a drilling surface of a bit face, the ratio of the total indenter area to the bit face area being defined by a parameter $KPI_1$ (expressed as a percentage); the ratio of the average individual indenter area to the bit face area being defined by a parameter $KPI_2$, (expressed as a percentage) and wherein the relationship between $KPI_1$ and $KPI_2$ is defined by the equation:

$$KPI_2 >= 1.353\times10^{-6}(KPI_1)^5 - 1.527\times10^{-4}(KPI_1)^4 + 6.586\times10^{-3}(KPI_1)^3 - 1.301\times10^{-1}(KPI_1)^2 + 1.185(KPI_1) - 3.960$$

A drill bit with higher $KPI_1$ value will tend to exhibit better wear life compared to a drill bit with lower $KPI_1$ values. A drill bit with lower $KPI_2$ values will tend to exhibit better performance and efficiency compared a drill bit with higher $KPI_2$ values. The above relationship between $KPI_1$ and $KPI_2$ values is advantageous as drill bits where the intersection of the ratio of the total indenter area to the bit face area and the ratio of the average individual indenter area to the bit face area fall on or below the curve defined by the above equation exhibit improved wear life and better performance (i.e. faster drilling) compared to drill bits with ratios above the curve. If the KPI values are above the curve, drilling performance is most probably not optimised.

The average bit face area per indenter may be defined by a parameter $KPI_3$, having a value between about 90 sq. mm/indenter and 5000 sq. mm/indenter.

$KPI_3$ may have a value between about 90 sq. mm/indenter and 250 sq. mm/indenter.

$KPI_3$ may have a value between about 120 sq. mm/indenter and 500 sq. mm/indenter.

$KPI_3$ may have a value between about 130 sq. mm/indenter and 1100 sq. mm/indenter.

$KPI_3$ may have a value between about 140 sq. mm/indenter and 1400 sq. mm/indenter.

$KPI_3$ may have a value between about 160 sq. mm/indenter and 1700 sq. mm/indenter.

$KPI_3$ may have a value between about 180 sq. mm/indenter and 2000 sq. mm/indenter.

$KPI_3$ may have a value between about 200 sq. mm/indenter and 2300 sq. mm/indenter.

$KPI_3$ may have a value between about 250 sq. mm/indenter and 2600 sq. mm/indenter.

$KPI_3$ may have a value between about 300 sq. mm/indenter and 2900 sq. mm/indenter.

$KPI_3$ may have a value between about 400 sq. mm/indenter and 3400 sq. mm/indenter.

$KPI_3$ may have a value between about 800 sq. mm/indenter and 4000 sq. mm/indenter.

$KPI_3$ may have a value between about 1000 sq. mm/indenter and 5000 sq. mm/indenter.

A drill bit with a lower $KPI_3$ value will generally exhibit improved performance and better wear life compared to a drill bit with a higher $KPI_3$ value. However, the appropriate $KPI_3$ value depends on the impact mechanism to which the bit is fitted, and the rock type being drilled. Larger impact mechanisms apply higher amounts of work per loading cycle and thus have higher $KPI_3$ optimum values, for a given rock type. The above ranges are advantageous as providing drill bits with $KPI_3$ values within the specified range (depending on the impact mechanism size) provides for increased wear life and better performance compared to drill bits with $KPI_3$ values outside of these ranges.

The multi-indenter drill bit may be used in a down-the-hole hammer. Furthermore, the multi-indenter drill bit may be used in a hydraulic down-the-hole hammer.

A further embodiment of the present invention provides a method of fabricating a multi-indenter drill bit comprising:

defining a drill bit face area;

defining a number of drill bit indenters;

defining the size of the drill bit indenters;

Such that a ratio of total indenter area to bit face area provides a value $KPI_1$; a ratio of average individual indenter area to bit face area provides a value $KPI_2$; and the relationship between $KPI_1$ and $KPI_2$ (both in %) is defined by the equation:

$$KPI_2 >= 1.353\times10^{-6}(KPI_1)^5 - 1.527\times10^{-4}(KPI_1)^4 + 6.586\times10^{-3}(KPI_1)^3 - 1.301\times10^{-1}(KPI_1)^2 + 1.185(KPI_1) - 3.960$$

DETAILED DESCRIPTION

Figure 1:
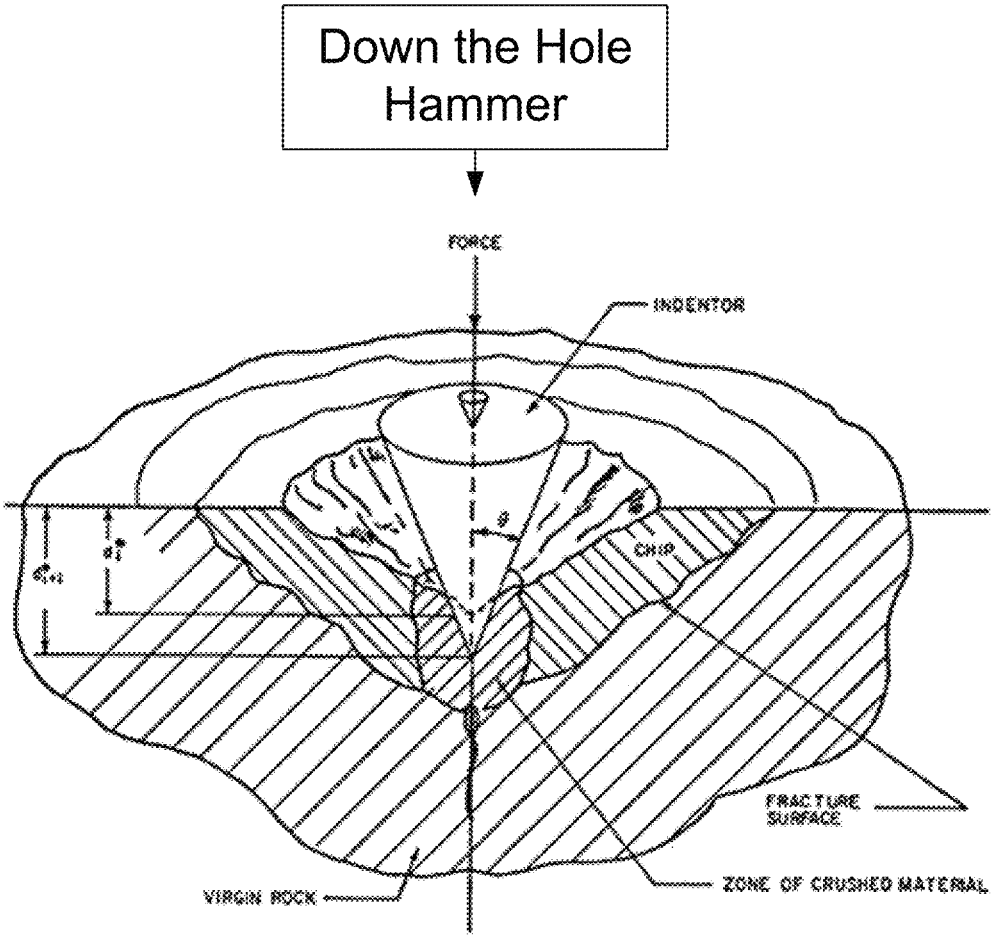
FIG. 1 is a schematic representation of a drill indenter drilled into rock [1]
Figure 2:
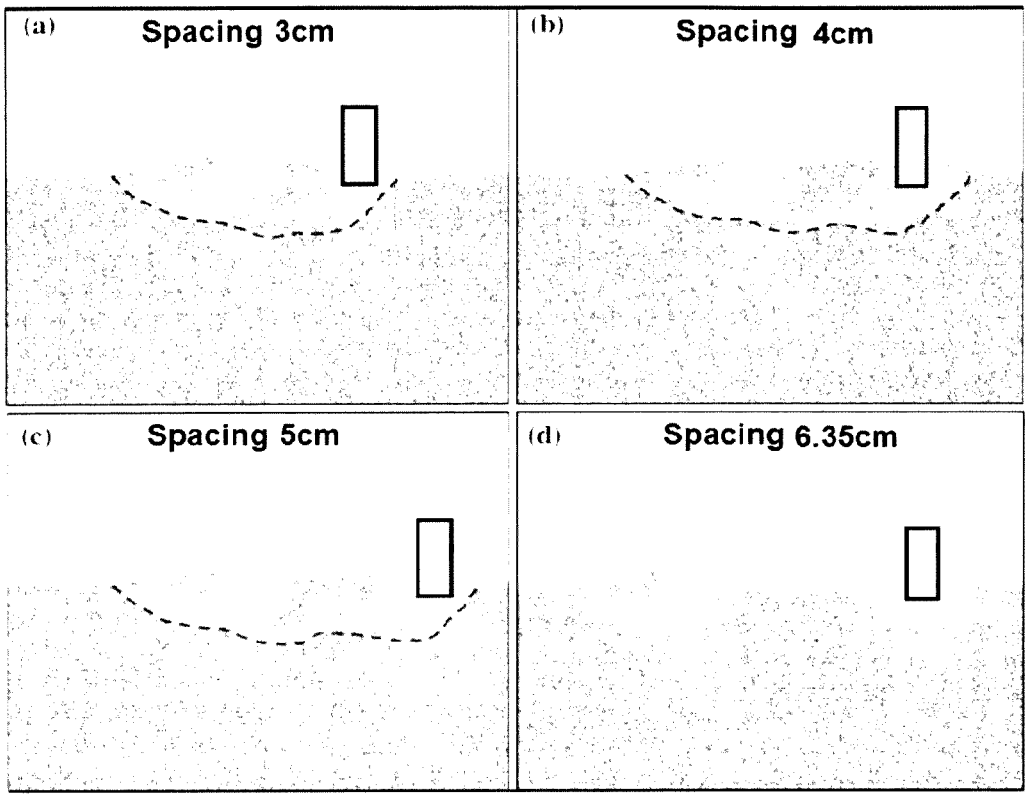
FIG. 2 shows a number of examples of drill indenter spacing and associated fracture coalescence [2]

Many design options are available when designing a given drill bit. Parameters include the total area of the bit face, the number of indenters, the size of the indenters and the spacing between indenters relative to adjacent indenters. Altering each of these parameters will affect the functionality of the drill bit and will have an effect on the drilling efficiency of the bit. In studying these parameters and their effects, a number of Key Performance Indicators, or KPIs, between the bit features have been established which allow for the performance of drill bits to be investigated for improved performance over known bits. Drill bits are fabricated based on the optimum KPI values.

KPI Values

For any given rock type, and indenter loading, there is an optimum indenter spacing which provides for the greatest volume of chips to be removed or liberated during drilling due to coalescence of cracks. The area around each indenter is a measure of its 'average' spacing from the surrounding indenters. It follows that for a two-dimensional case there is also an optimum area around each indenter for maximum chip volume removal. It is also well known that a smaller diameter and/or sharper indenter will create chips more efficiently than one that is larger and/or more blunt. This suggests that a drill bit, with a fixed amount of input work available, can drill faster (i.e. liberate more chips), if the indenters are small in diameter and optimally spaced. Thus, multiple small indenters would appear to provide an optimum solution. However, there are also some other practical issues to consider in design of the drill bit with a large number of small diameter indenters; for example, as the indenter diameter decreases, the wear rate (of the indenters) increases. Also, the more indenters that are used, the lower the average input work available to each indenter.

Considering all of the above relevant factors, three important Key Performance Indicators (KPIs) can be created which can be applied to drill bits of all sizes:

1. $KPI_1$—Ratio of total indenter area to bit face area (expressed as a percentage)

This provides a measure of the proportion of the bit face which is taken up with indenters, and, with that, an indication of the drill bit's wear resistance. i.e. [Total indenter area/Bit face area].

2. $KPI_2$—Ratio of (average) individual indenter area to bit face area (expressed as a percentage).

Specifically, this is defined by [Total area of the indenters/Number of indenters]/Bit Face Area. This provides a measure of the average size of each indenter relative to the size of the bit (i.e. how 'sharp' are the indenters, on average, relative to the bit size).

3. $KPI_3$—Bit face area per indenter

This is defined by [Bit face area/Total number of indenters]. This provides a measure of the average area surrounding each indenter. This is not a ratio, but rather an absolute (average) area per indenter in $mm^2$. This provides a 'scale' factor for the drill bit where it can be matched to the output of the impact mechanism it is fitted to.

For the range of percussion mechanisms available it has been shown that drill bits can drill considerably faster if $KPI_2$ and $KPI_3$ are kept below a certain calculated value.

It has also been shown that wear life of drill bits can be improved if $KPI_1$ is kept above a certain calculated value.

EXAMPLE

Figure 3:
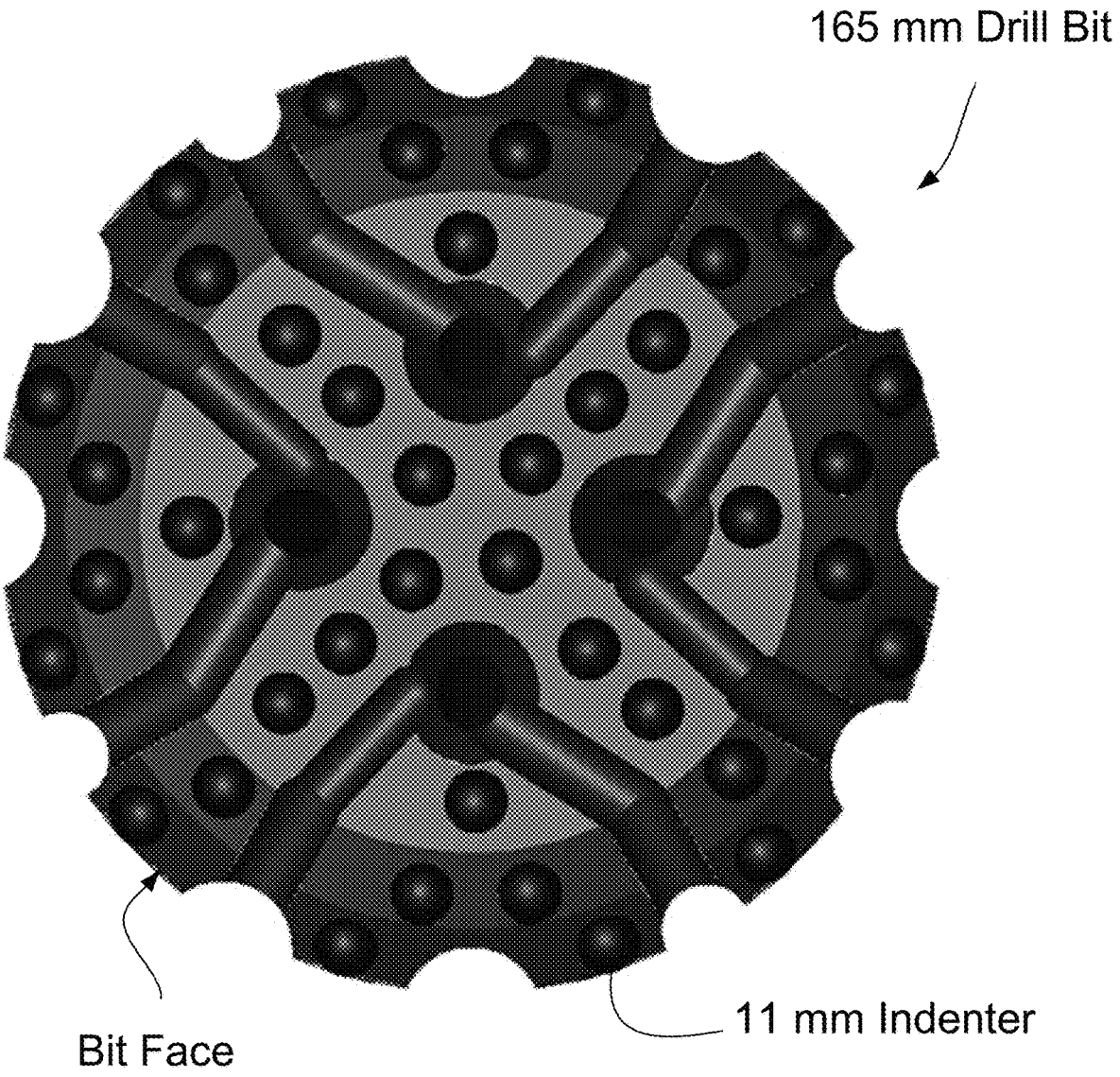
FIG. 3 shows a 165 mm drill bit with 40 11 mm diameter indenters.
Figure 4:
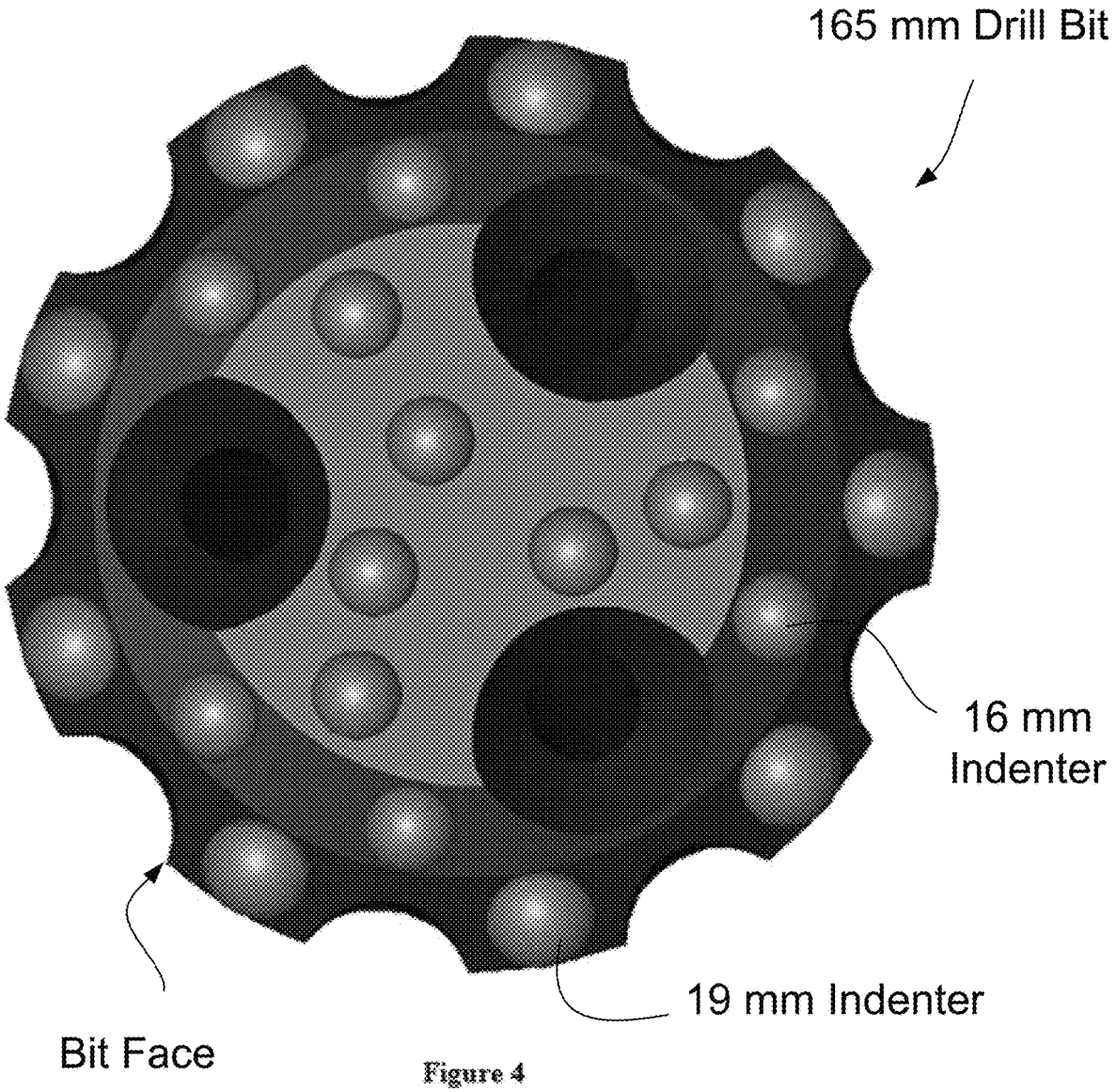
FIG. 4 shows a 165 mm drill bit with 9 19 mm diameter indenters and 12 16 mm diameter indenters.
Figure 5:
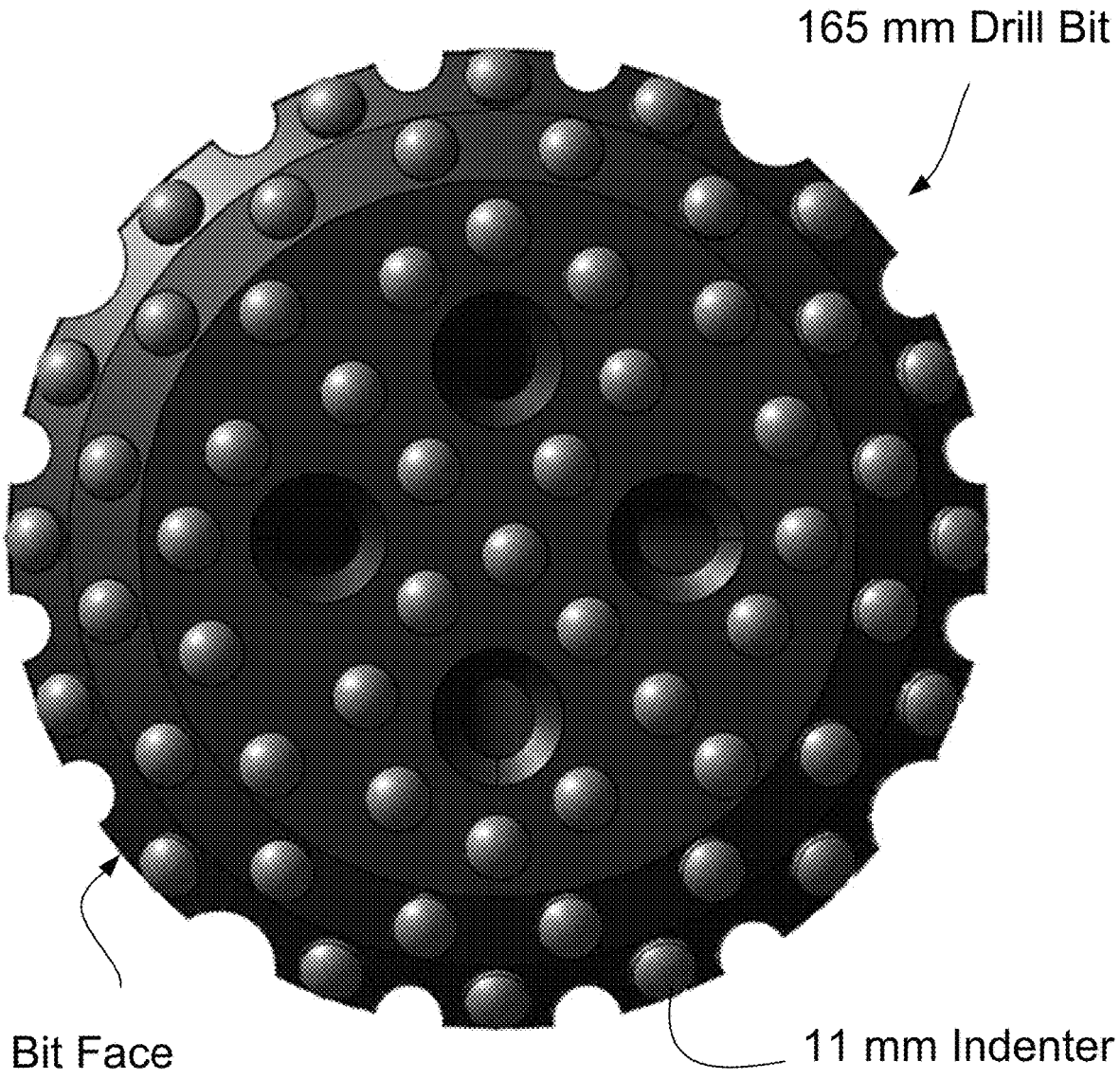
FIG. 5 shows a 165 mm drill bit with 57 11 mm diameter indenters.
Figure 6:
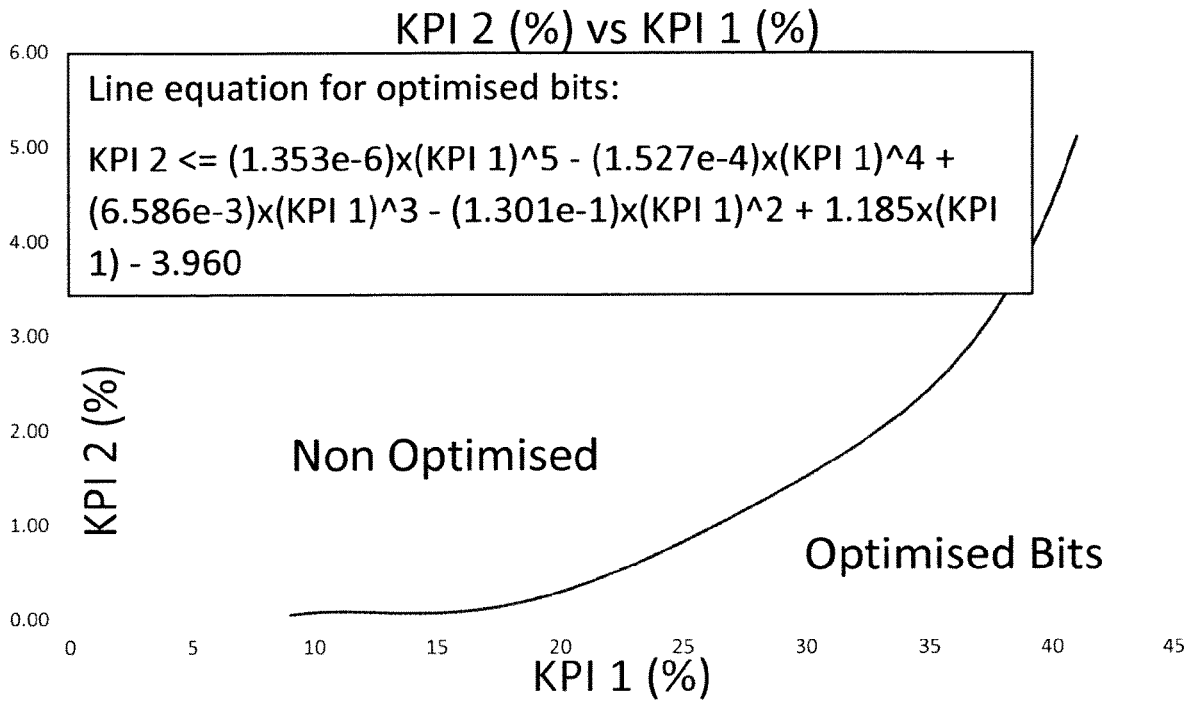
FIG. 6 shows a plot of $KPI_2$ (Ratio of (average) individual indenter area to bit face area) versus $KPI_1$ (Ratio of total indenter area to bit face area) for a range of values.

As an example, FIGS. 3, 4 and 5 show three different 165 mm diameter drill bit designs:

1. BIT 1—With 40 11 mm diameter indenters
2. BIT 2—With 9 19 mm diameter indenters and 12 16 mm diameter indenters.
3. BIT 3—With 57 11 mm diameter indenters Calculating the area values for these bits provides:

1. BIT 1—Total bit face area: 21.382 $mm^2$, total indenter area: 3.801 $mm^2$, average indenter area: 95 $mm^2$
2. BIT 2—Total bit face area: 21.382 $mm^2$, total indenter area: 4.964 $mm^2$, average indenter area: 236 $mm^2$
3. BIT 3—Total bit face area: 21.382 $mm^2$, total indenter area: 5416 $mm^2$, average indenter area: 95 $mm^2$ Calculating the KPI's as above for each of these bits provides the following values.

TABLE 1

| | $KPI_1$ | $KPI_2$ | $KPI_3$ |
|---|---|---|---|
| BIT 1 | 17.7% | 0.44%, | 534 $mm^2$ |
| BIT 2 | 23.2% | 1.1%, | 1,018 $mm^2$ |
| BIT 3 | 25.3% | 0.44% | 375 $mm^2$ |

Thus, on the basis of the above calculated KPIs it can be expected that in most rock types BIT 1 will drill faster than BIT 2 as BIT 1 has a lower $KPI_2$ and $KPI_3$ value. However, BIT 2 will have a better lifespan (i.e. less indenter wear) as BIT 2 has a comparatively higher $KPI_1$ value. However, for $BIT_3$ all three KPI's show an improvement over BIT 2.

Thus, this indicates that a higher indenter count for a given bit face area compared to more conventional drill bits provides an improvement in each of $KPI_1$, $KPI_2$ and $KPI_3$. Thus an optimum indenter count for a given bit face area may be derived which takes account of the disadvantages of a higher indenter count (i.e. lower average input work available to each indenter) while still providing for an improved drill bit performance.

On this basis, KPI values are calculated for a number of drill bits based on a number of parameters; namely bit size (mm), number of indenters, bit area (sq mm) and total indenter area. These results are then compared to a conventional prior art drill bit.

TABLE 2

| | Prior Art Bit | Trial Bit 1 | Trial Bit 2 | Trial Bit 3 |
|---|---|---|---|---|
| Bit size (mm) | 165 | 165 | 165 | 165 |
| Number of indenters | 20 | 30 | 40 | 55 |
| Bit area (sq mm) | 21383 | 21383 | 21383 | 21383 |
| Total indenter area (sq mm) | 5671 | 3800 | 3801 | 5227 |
| KPI 1: total indenter area/bit area | 27% | 18% | 18% | 24% |
| KPI 2: (average area/indenter)/bit area$^2$ | 1.33% | 0.59% | 0.44% | 0.44% |
| KPI 3: bit area/no of indenters (sq mm ea) | 1069 | 713 | 535 | 389 |

Thus, it can be seen when comparing Trial bit 1 and Trial bit 2 to the Prior Art bit that increasing the number of indenters leads to a corresponding increase in drilling performance, as $KPI_2$ and $KPI_3$ of Trial bits 1 and 2 are lower compared to the prior art bit. However, Trial bits 1 and 2 display increased wear as the $KPI_1$ value for Trial bits 1 and 2 is lower than the prior art bit.

If, however, Trial bit 3 is compared to the Prior Art bit, it can be seen that not only is improved drilling performance displayed (i.e. as evidenced by the lower $KPI_2$ and $_3$ values), but also Trial bit 3 shows comparable wear performance to that of the prior art bit.

In effect increasing the number of indenters significantly (i.e. 55 indenters on Trial bit 3 compared to 20 indenters on the Prior Art bit) provides improved drilling performance without any significant decrease in wear performance. Typically, industrial bit design is normally a 'trade off' between drilling speed and bit wear life. The present invention however provides for enhanced drilling speed while also providing no significant decrease in wear life.

Furthermore, it can be seen that calculating the KPI values in this manner provides information which can be used to select the most suitable drill bit for a given drilling task.

For example, if faster drilling is required, a bit with a lower value of $KPI_2$ and $KPI_3$ may be selected and fabricated. Alternatively, if longer wear is the primary design requirement, a bit with a higher value of $KPI_1$ may be selected and fabricated. Furthermore, the calculation of KPIs in this manner allows a drill bit with optimum KPI 1, 2 and 3 to be fabricated which provides both improved drilling and an optimised lifespan.

Thus, calculating optimum KPI values provides that an equation may be derived defining a relationship between KPI values for optimum drilling performance. It has thus been calculated that a drill bit comprising a plurality of indenters about a bit face provides optimum performance wherein the ratio of the total indenter area to the bit face area, $KPI_1$ and the ratio of the average individual indenter area to the bit face area, $KPI_2$, (both expressed as a percentage) are related such that:

$$KPI_2 >= 1.353\times10^{-6}(KPI_1)^5 - 1.527\times10^{-4}(KPI_1)^4 + 6.586\times10^{-3}(KPI_1)^3 - 1.301\times10^{-1}(KPI_1)^2 + 1.185(KPI_1) - 3.960 \quad \text{(Equation 1)}$$

As such, drill bits with $KPI_2$ values falling on or below a curve defined by Equation 1 display enhanced performance compared to drill bits with $KPI_2$ falling above the curve.

Furthermore, drill bits with values defined as per Equation 1 may be produced with a range of $KPI_3$ values scaled as appropriate for the impact mechanism to which the bit is fitted. Impact mechanisms are commonly manufactured in discrete sizes, correlating to the impact work they can deliver per blow, which is a function of the impact piston's mass. This is particularly the case with down-the-hole impact mechanisms, where the maximum diameter of the impact piston is constrained by the hole size being drilled. Manufacturers have generally standardised on a range of mechanism sizes, designated by the hole sizes (in inches) they are primarily designed to drill. Sizes 3" (76.2 mm), 3.5" (88.9 mm), 4" (101.6 mm), 4.5" (114.3 mm), 5" (127 mm), 5.5" (139.7 mm), 6" (152.4 mm), 6.5" (165.1 mm), 8" (203.2 mm), 12" (304.8 mm), 18" (457.2 mm), 24" (609.4 mm) are commonly produced. These down-the-hole impact mechanisms (known as down-the-hole hammers) deliver applied work per blow which increases with the designated size. It follows that the optimum $KPI_3$ value for the drill bits used with these hammers will increase with the hammer size. So, for example, a drill bit manufactured for use in, say, a 6" down-the-hole hammer, would have a smaller optimum $KPI_3$ value when compared to a drill bit manufactured for use in a 6.5" hammer, when drilling the same rock type.

Provided the relationship between $KPI_2$ and $KPI_1$ is as described by Equation 1, bit performance and wear life will be improved over prior art designs. However, the performance of a drill bit in a particular rock type, used in a particular impact mechanism size is further enhanced when the $KPI_3$ value is at an appropriate level.

For a 3" hammer, $KPI_3$ may have a value between about 90 sq. mm/indenter and 250 sq. mm/indenter. For a 3.5" hammer, $KPI_3$ may have a value between about 120 sq. mm/indenter and 500 sq. mm/indenter. For a 4" hammer, $KPI_3$ may have a value between about 130 sq. mm/indenter and 1100 sq. mm/indenter. For a 4.5" hammer, $KPI_3$ may have a value between about 140 sq. mm/indenter and 1400 sq. mm/indenter. For a 5" hammer, $KPI_3$ may have a value between about 160 sq. mm/indenter and 1700 sq. mm/indenter. For a 5.5" hammer, $KPI_3$ may have a value between about 180 sq. mm/indenter and 2000 sq. mm/indenter. For a 6" hammer, $KPI_3$ may have a value between about 200 sq. mm/indenter and 2300 sq. mm/indenter. For a 6.5" hammer, $KPI_3$ may have a value between about 250 sq. mm/indenter and 2600 sq. mm/indenter. For an 8" hammer, $KPI_3$ may have a value between about 300 sq. mm/indenter and 2900 sq. mm/indenter. For a 12" hammer, $KPI_3$ may have a value between about 400 sq. mm/indenter and 3400 sq. mm/indenter. For an 18" hammer, $KPI_3$ may have a value between about 800 sq. mm/indenter and 4000 sq. mm/indenter. For a 24" hammer, $KPI_3$ may have a value between about 1000 sq. mm/indenter and 5000 sq. mm/indenter.

Furthermore, a method of fabricating a multi-indenter drill bit is provided comprising the steps of defining a drill bit face area, defining a number of drill bit indenters and defining the size of the drill bit indenters; such that the relationship between $KPI_1$ and $KPI_2$ is defined by equation 1.

Drill bits as described may be used with a variety of hammer types such a down-the-hole (DTH) hammers and hydraulic down-the-hole hammers.

The words "comprises/comprising" and the words "having/including" when used herein with reference to the present invention are used to specify the presence of stated features, integers, steps or components but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

REFERENCES

[1]. Miller et al. Int. Journ. Rock Mech. Min. Sci. Vol. 5, pp. 375-398.

[2]. Moon et al. Rock Mech Rock Eng (2012) 45:837-849, DOI 10.1007/s00603-011-0180-3

The invention claimed is:

1. A method of fabricating a down-the-hole hammer multi-indenter drill bit for use in down-the-hole hammer drilling of a hole, the drill bit including a plurality of indenters arranged on a drilling surface of a bit face, the method comprising:

defining a drill bit face area;

defining a number of drill bit indenters;

defining a total area of the drill bit indenters, wherein a ratio, expressed as a percentage, of total indenter area to bit face area provides a value $KPI_1$ (Key Performance Indicator 1), and a ratio, expressed as a percentage, defined by (the total area the drill bit indenters/the number of indenters)/(bit face area), provides a value $KPI_2$ (Key Performance Indicator 2); and using the equation $$KPI_2 <= 1.353\times10^{-6}(KPI_1)^5 - 1.527\times10^{-4}(KPI_1)^4 + 6.586\times10^{-3}(KPI_1)^3 - 1.301\times10^{-1}(KPI_1)^2 + 1.185(KPI_1) - 3.960$$

to constrain a relationship between $KPI_1$ and $KPI_2$.

2. The method according to claim 1, further comprising defining the bit face area/the total number of indenters by a parameter $KPI_3$, wherein a value of $KPI_3$ is between 90 sq. mm/indenter and 5,000 sq. mm/indenter.

3. The method according to claim 2, wherein the value of $KPI_3$ is between 90 sq. mm/indenter and 250 sq. mm/indenter.

4. The method according to claim 2, wherein the value of $KPI_3$ is between 120 sq. mm/indenter and 500 sq. mm/indenter.

5. The method according to claim 2, wherein the value of $KPI_3$ is between 130 sq. mm/indenter and 1,100 sq. mm/indenter.

6. The method according to claim 2, wherein the value of $KPI_3$ is between 140 sq. mm/indenter and 1,400 sq. mm/indenter.

7. The method according to claim 2, $KPI_3$ wherein the value of $KPI_3$ is between 160 sq. mm/indenter and 1,700 sq. mm/indenter.

8. The method according to claim 2, wherein the value of $KPI_3$ is between 180 sq. mm/indenter and 2,000 sq. mm/indenter.

9. The method according to claim 2, wherein the value of $KPI_3$ is between 200 sq. mm/indenter and 2,300 sq. mm/indenter.

10. The method according to claim 2, wherein the value of $KPI_3$ is between 250 sq. mm/indenter and 2,600 sq. mm/indenter.

11. The method according to claim 2, wherein the value of $KPI_3$ is between 300 sq. mm/indenter and 2,900 sq. mm/indenter.

12. The method according to claim 2, wherein the value of $KPI_3$ is between 400 sq. mm/indenter and 3,400 sq. mm/indenter.

13. The method according to claim 2, wherein the value of $KPI_3$ is between 800 sq. mm/indenter and 4,000 sq. mm/indenter.

14. The method according to claim 2, wherein the value of $KPI_3$ is between 1,000 sq. mm/indenter and 5,000 sq. mm/indenter.

15. The method according to claim 1, comprising using the drill bit in a hydraulic down-the-hole hammer.

* * * * *